US006837088B1

(12) United States Patent
Kleber et al.

(10) Patent No.: US 6,837,088 B1
(45) Date of Patent: Jan. 4, 2005

(54) BLOW-FORMING FLASK AND TOOL ASSEMBLY

(75) Inventors: Richard Murray Kleber, Clarkston, MI (US); Edward W. Bennett, Clarkston, MI (US); Richard Harry Hammar, Utica, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/797,228

(22) Filed: Mar. 10, 2004

(51) Int. Cl.[7] ..... B21D 26/02
(52) U.S. Cl. ..... 72/60; 72/57; 72/63; 29/421.1
(58) Field of Search ..... 72/56, 57, 58, 72/59, 60, 61, 62, 63, 36; 29/421.1

(56) References Cited

U.S. PATENT DOCUMENTS 3,934,441 A * 1/1976 Hamilton et al. ..... 72/60
4,352,280 A * 10/1982 Ghosh ..... 72/60
4,901,552 A * 2/1990 Ginty et al. ..... 72/60
4,984,348 A * 1/1991 Cadwell ..... 72/60
5,209,093 A * 5/1993 Cadwell ..... 72/62
5,661,992 A * 9/1997 Sanders ..... 72/60
6,253,588 B1 * 7/2001 Rashid et al. ..... 72/57

* cited by examiner

*Primary Examiner*—David B. Jones
(74) *Attorney, Agent, or Firm*—Kathryn A. Marra

(57) ABSTRACT

A flask and tool assembly includes a forming tool insert that is housed within an insulated flask having four vertical sides. An insulation enclosure surrounds the flask and the flask contains a heater plate for contacting the bottom of the forming tool insert. The tops of the sides of the flask provide surfaces for gripping bottom edges of a sheet metal blank to be formed. A cover for the tool-containing flask provides complementary gripping surfaces for top edges of the sheet metal blank and defines a chamber above the sheet metal blank for pressurized forming gas. A peripheral seal underlies the sheet metal blank and bridges a space between the outer side surfaces of the forming tool insert and the inner surfaces of the sides of the flask, thereby obviating the need to provide a precision fit between the flask and forming tool insert.

16 Claims, 3 Drawing Sheets

BLOW-FORMING FLASK AND TOOL ASSEMBLY

TECHNICAL FIELD

The present invention generally pertains to hot-gas blow-forming of metal alloy sheet blanks into articles of complex curvature such as automotive body panels. More specifically, this invention pertains to a heated flask tool assembly and a related perimeter seal for use with hot-gas blow-forming operations such as super-plastic-forming (SPF) or quick-plastic-forming (QPF).

BACKGROUND OF THE INVENTION

Automotive body panels are typically produced by forming low carbon steel or aluminum alloy sheet stock into desired panel shapes, often by conventional room temperature processes such as stamping. Such body panels, however, can also be produced hot gas blow-forming processes, such as SPF. Compared to conventional stamping processes, SPF processes are capable of producing more complex panel shapes from a single sheet of material. SPF processes involve complex integrally heated presses and low material deformation rates that yield cycle times typically between 20 and 60 minutes. Such relatively long cycle times are incompatible with automotive production rates. Also, because SPF heat sources are remotely located from SPF forming tool surfaces, SPF processes do not provide a high degree of temperature control at the workpiece.

Therefore, QPF processes were developed to reduce the cycle time of SPF and to provide better temperature control closer to forming tool surfaces by attaching insulation to, and embedding heating elements within, the forming tools themselves. Providing insulation and heating elements in each forming tool, however, requires a lead time to produce QPF forming tools and increases the costs thereof. Such investment costs are recoverable by suitable production volumes. With lower volume production runs, however, internally or integrally heated hot forming tools may be too expensive.

Thus, there is a need for a hot blow-form tooling apparatus that avoids the expense and lead times associated with producing integrally heated tooling, and avoids the long cycle times and lack of localized temperature control of SPF processes.

SUMMARY OF THE INVENTION

The present invention provides low-cost hot blow-forming tooling that is particularly adapted for the shaping of prototype sheet metal parts or sheet metal parts in low volume production. A forming surface for the sheet metal is machined in the top of one or more blocks of tool steel or other suitable tool material. A flask for holding the forming tool is provided wherein the flask has four vertical sides. An insulation enclosure may be provided to partially surround and thereby insulate the flask. The flask contains a heater plate for contacting the bottom of the forming tool block, and the tops of the sides of the flask provide surfaces for gripping bottom edges of a sheet metal blank to be formed. A cover for the tool-containing flask provides a chamber for pressurized forming gas and complementary gripping surfaces for top edges of the sheet metal blank. An insulation enclosure may be provided to partially surround and thereby insulate the cover. The present invention also uses a peripheral seal to underlie the sheet metal blank and bridge a space between the outer side surfaces of the tool block and the inner surfaces of the sides of the flask, thereby obviating the need to provide a precision fit between the various tool components.

In a representative assembly of a flask and forming tool block, the flask is insulated by an insulation enclosure and is carried on a flat rectangular base plate for mounting to a press platen. The flask is suitably rectangular wherein the four vertical sides of the flask provide top surfaces for supporting an overlying sheet metal blank. If necessary, one or more spacer rails may be mounted within the flask to provide height adjustment for a particular forming tool block. A heater plate is mounted atop the spacer rails within the flask for heating a forming tool to a suitable superplastic forming temperature. The heater plate includes embedded electrical resistance heating elements connected to a suitable controlled electrical power source. A die or forming tool block, selected for the current forming operations, is mounted atop the heater plate within the flask for to provide a forming surface for a sheet metal blank. A sheet metal blank is placed on the top surfaces of the sides of the flask so that it overlies the forming surface of the forming tool in the flask. Then, an insulated cover for the flask is positioned above the sheet metal blank. The periphery of the cover includes a seal bead having a binder surface for gripping the sheet metal blank to the top surfaces of the flask. The cover also defines a pressure chamber over the sheet metal blank to receive a pressurized gas to blow form the sheet metal blank against the machined surface of the inserted forming tool. The flask is sized to accommodate different forming tools for different low production sheet metal forming operations. Usually there is a peripheral gap or void is defined between an exterior periphery of the form tool insert and an interior periphery of the flask. Therefore, a peripheral seal is provided to bridge such a gap or void.

In contrast to the prior art, the press itself and the major sub-elements of the press are not integrally heated. Likewise, the forming tools themselves are not integrally heated or insulated. Rather, the investment expense and lead time required to provide such insulation and heating elements are borne by the dedicated heated and insulated tool enclosures of the present invention. Thus, the expense and lead time associated with such auxiliary apparatus can be eliminated from each individual set of forming tools that are swapped in and out of the reusable containers.

Moreover, the peripheral seal is provided to bridge the peripheral gap between the machined forming tool block and the sides of the flask thereby preventing the sheet metal blank from being pushed down into the peripheral gap when the upper chamber is pressurized. The peripheral seal also eliminates the need to provide a precision fit between the form tool insert and flask, and enables "hot" tooling to be swapped out for "cold" tooling without having to wait for the hot tooling to cool. Accordingly, the peripheral seal eliminates machining costs and increases production throughput.

BRIEF DESCRIPTION OF THE DRAWINGS

These and other features and advantages of the invention will become apparent upon reading the detailed description in combination with the accompanying drawings, in which.

DESCRIPTION OF THE PREFERRED EMBODIMENT

Figure 1:
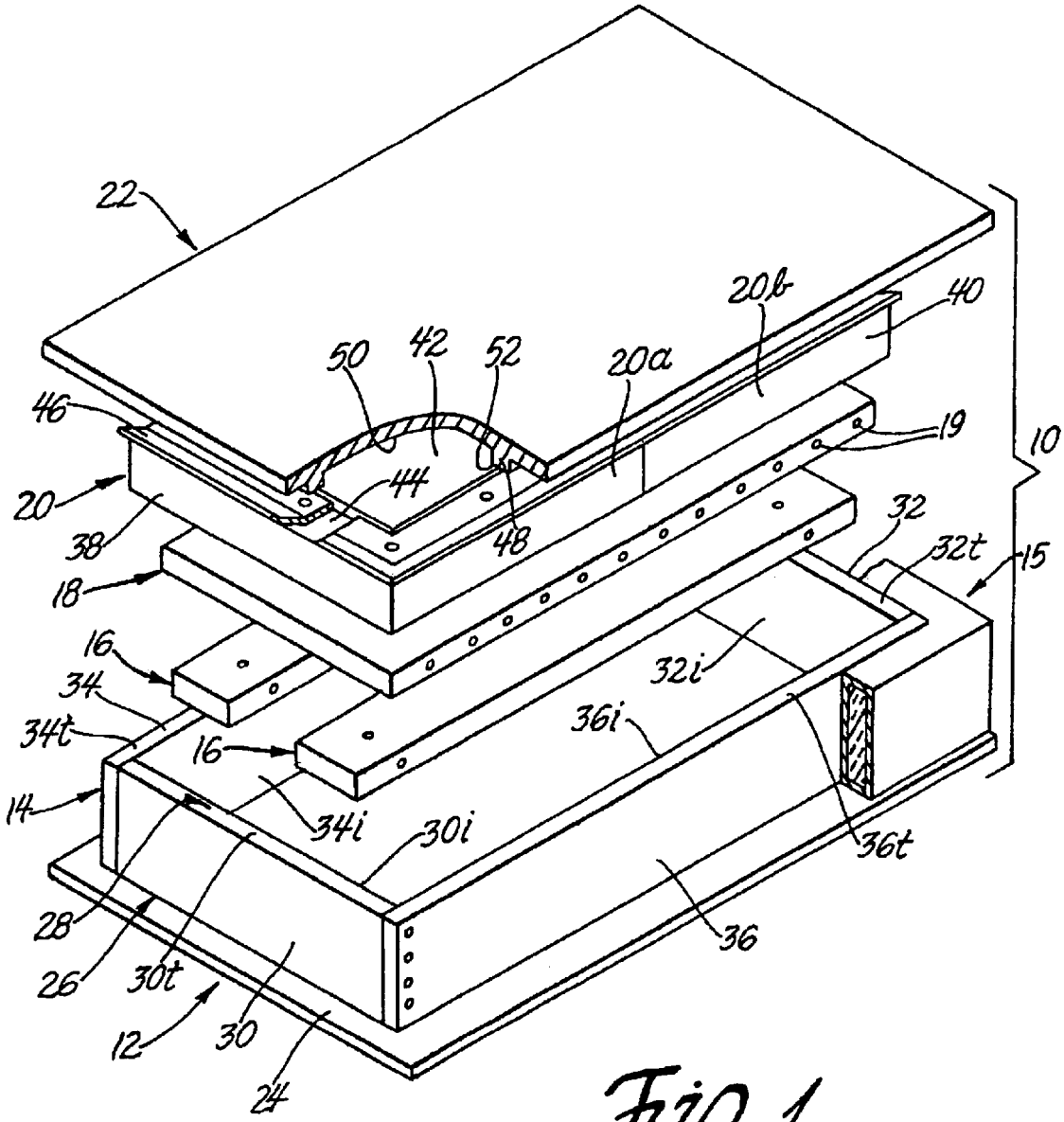
FIG. 1 illustrates an exploded perspective view of a flask tool assembly including a heater plate and a thermally-compensating perimeter seal according to an embodiment of the present invention.

Referring specifically to the Figures, there is illustrated in FIG. 1 a flask tool assembly 10 in exploded view for use with hot-gas blow-forming processes such as superplastic forming (SPF), quick-plastic-forming (QPF), or the like. The flask tool assembly 10 includes a base plate 12 for supporting the assembly, a four-sided housing or flask 14 mounted atop the base plate 12, an insulation enclosure 15 laterally or partially surrounding the flask 14, a pair of spacer rails 16 mounted atop the base plate 12 within the flask 14 to provide height adjustment, a heater plate 18 mounted atop the spacer rails 16 within the flask 14 for heating the assembly, a form tool insert 20 mounted atop the heater plate 18 within the flask 14 for forming a sheet metal blank, and a cover 22 positioned atop the assembly to define a pressure chamber. The flask tool assembly 10 and components thereof are shown as generally rectangular in shape, but may be any shape that is necessitated by the desired forming process and final part shape.

The mounting plate or base plate 12 may be a separate component from the flask 14 or may be integrated therewith as a single component. In any case, the base plate 12 is preferably composed of P20 steel or the like, is generally rectangular, and for exemplary purposes measures about 141" along its sides, 85" along its ends, and 4" in thickness. The base plate 12 also includes a top surface 24 thereon for supporting the flask 14. Preferably, the base plate 12 includes on the order of about 30 load posts (not shown) that are evenly distributed about, and extend upwardly from, the top surface 24 of the base plate 12. The load posts are preferably spool-shaped, composed of Inconel®, and are about 2–3" in diameter and about 6" in height. Four press mounting slots (not shown) may also be formed along each side of the base plate 12 and two material handling brackets (not shown) may also be provided on each side of the base plate 12. Accordingly, the base plate 12 provides an attachment means and rigid support for the flask tool assembly 10 to a press bed (not shown). The base plate 12 also provides a means for material handling of the flask tool assembly 10 by way of the material handling brackets.

The housing, container, or flask 14 is a four-sided structure composed preferably of P20 steel plates, or the like, and is open at a top end 28 thereof. The flask 14 includes a base plate (not shown), two ends 30, 32, and two sides 34, 36. As such, the flask 14 is generally rectangular in shape and for exemplary purposes measures about 131" along its sides 34, 36, about 75" along its ends 30, 32, and about 31" in height. The base preferably includes three evenly spaced locating pins (not shown) centrally disposed along the length of the base that provide alignment for the form tool insert 20. The sides 34, 36 may also include access holes (not shown) therethrough. The flask 14 may be mounted to the tops of the load posts of the base plate 12 and fastened to the base plate such as by tension rods (not shown) or by any known attachment method such as by welding, attaching with fasteners, or the like. The flask 14 includes opposed ends 30, 32 and opposed sides 34, 36 that are fastened together by fasteners such as bolts, cap screws, or the like. Each of the ends 30, 32 and sides 34, 36 include top surfaces **30*t*, 32*t*, 34*t*, 36*t*, which are machined and collectively define a top surface of the flask 14. Also, the ends 30, 32 and sides 34, 36 collectively define an interior of the flask 14 and an interior periphery of the flask 14. The ends 30, 32 and sides 34, 36 also include internal side surfaces 30*i*, 32*i*, 34*i*, 36*i* that collectively define an interior surface of the flask 14. Accordingly, the flask 14 provides a support perimeter or binder ring function for supporting the sheet metal blank, and locates and supports the form tool insert 20**.

The insulation enclosure 15 is only partially shown and in broken out form, for ease of illustration. It is to be understood that the insulation enclosure 15 actually surrounds the ends and sides 30, 32 and 34, 36 of the flask 14 as well as the base 26 of the flask 14. The insulation enclosure 15 is generally rectangular in shape and is constructed of one base member, two sides, and two ends (not shown). The insulation enclosure 15 measures about 131" along its sides, about 85" along its ends, and about 11" in height. The base member includes clearance holes (not shown) therethrough that correspond in quantity and location to the quantity and locations of the load posts of the base plate 12, such that the load posts pass therethrough to provide support to the flask 14. Thus, neither the base nor the sides or ends are composed of load bearing insulation. Rather, each of the members or panels of the insulation enclosure 15 may be an assembly constructed of an outer shell composed of, for example, 304 stainless steel, and an internal insulation material composed of, for example, Cer-Wool RT available from Premier Refractories and Chemicals, Inc. of King of Prussia, Pa., or the like. Accordingly, the insulation enclosure 15 insulates the flask 14 to keep heat in and protect the shop environment outside of the hot flask 14.

The shims or spacer rails 16 are rectangular shaped blocks preferably composed of P20 steel, or the like. The spacer rails 16 are mounted and fastened to the top surface 24 of the base plate 12 within the confines or interior of the flask 14. The spacer rails 16 provide height adjustment for the assembly so as to accommodate form tool inserts of varying thicknesses. Accordingly, the spacer rails 16 may be provided in a variety of thicknesses and may be omitted altogether if unnecessary.

The heater plate 18 is a rectangular shaped structure, preferably composed of P20 steel or the like, and measures for example about 118" in length, about 45" in width, and about 3" in thickness. The heater plate 18 mounts atop the base of the flask 14 and includes through holes or slots (not shown) to permit the locating pins of the flask 14 to pass therethrough. The heater plate 18 also includes electrical heating elements 19 embedded therein for warming the form tool insert 20 to suitable temperatures for superplastic forming. It is known to embed electrical heating elements within SPF dies and within SPF press platens. It is also known to embed such heating elements within QPF forming tools. Uniquely, however, the present invention involves embedding the electrical heating elements 19 within the separate or intermediate heater plate 18, wherein the apparatus is operated in accordance with known QPF principles such as that disclosed in U.S. Pat. No. 6,253,588, which is assigned to the assignee hereof and which is incorporated by reference herein. The heater plate 18 is mounted directly atop the spacer rails 16 within the interior of the flask 14. The heater plate 18 thus provides a housing for the heater elements 19 and, therefore, a heat source that is internal to the flask tool assembly 10 and may be used repeatedly from one form tool insert to the next.

The die, product detail load, or form tool insert 20 is a generally two-piece rectangular structure having opposed ends 38 (only one end shown) and sides 40 (only one side shown) and may be composed of steel, titanium, aluminum, refractory materials, or the like. Preferably, the form tool insert 20 is composed of two sub-assemblies 20*a*, 20*b* retained together by a tie plate (not shown) beneath the form tool insert 20. The form tool insert 20 is preferably composed of P20 steel or the like, and measures for example about 120" in length, 64" in width, and about 24" in overall height. Vent channels (not shown) may be suitably provided within the form tool insert 20. Each of the opposed ends 38 and sides 40 collectively define an exterior periphery of the form tool insert 20. The form tool insert 20 is mounted directly atop the heater plate 18 and is preferably fastened thereto or to the base plate 12. The form tool insert 20 includes a forming surface 42 thereon that replicates the desired final part configuration to be formed and further includes a marginal or addendum surface 44 thereon around the forming surface 42. A perimeter or peripheral seal 46 is fastened to the addendum surface 44 around the circumference of the form tool insert 20 and measures for example about 123" in length, 67" in width, 1.5" in overall height, and about 0.1875" in thickness. Accordingly, the form tool insert 20 and seal 46 provide part definition surfaces for forming a component and provide a means for bridging a void between the form tool insert 20 and flask 14.

The pressure lid or cover 22 is a rectangular-shaped component that is preferably composed of P20 steel or the like. The cover 22 is preferably mounted to an upper platen of the press (not shown), such as by tension rods and hardware (not shown) or the like. Accordingly, the cover 22 is positioned above the form tool insert 20. Preferably, the cover 22 is heated, such as by embedding heating elements (not shown) therein. The cover 22 includes an integral seal bead 48 that projects from an underside surface 50 and circumscribes the cover 22 about a peripheral margin thereof. The seal bead 48 includes a machined surface 52 that is adapted for surface contact with the top surface 24 of the flask 14 to trap a sheet metal blank (not shown) therebetween. Accordingly, the machined surface 52 and top surface 24 act as binder surfaces for binding the edges or peripheral margin of the sheet metal blank when the cover 22 occupies a lowered position. In such position, the cover 22 also defines a pressure chamber above the top surface of the sheet metal blank for blow-forming the sheet metal blank against the form tool insert 20.

The cover 22 is preferably surrounded by an insulation enclosure (not shown) in similar fashion as the flask 14. It is to be understood that such an insulation enclosure actually surrounds the ends and sides of the cover 22, as well as a top portion (not shown) thereof. The insulation enclosure is generally rectangular in shape and is constructed of a top layer, two sides, and two ends (not shown). The insulation enclosure measures about 131" along its sides, about 85" along its ends, and about 11" in height. The top layer includes clearance holes (not shown) therethrough that correspond in quantity and location to a quantity and a plurality of locations of load posts (not shown) that interpose the cover 22 and upper platen of the press, such that the load posts pass therethrough to impart press load to the cover 22. Thus, neither the top layer nor the sides or ends are composed of load bearing insulation. Rather, each of the members or panels of the insulation enclosure may be an assembly constructed of an outer shell composed of, for example, 304 stainless steel, and an internal insulation material composed of, for example, Cer-Wool RT available from Premier Refractories and Chemicals, Inc. of King of Prussia, Pa., or the like. Accordingly, the insulation enclosure insulates the cover 22 to keep heat in and protect the shop environment outside of the cover 22.

Finally, like the base plate 12, a mounting plate (not shown) may be provided to establish an attachment means and rigid support for the cover to the upper press platen. The mounting plate also provides a means for material handling of the flask tool assembly 10 by way of material handling brackets (not shown) provided thereon. In other respects, the mounting plate may be identical to the base plate 12, including clearance holes (not shown) for tension rods (not shown) to pass therethrough.

Figure 2:
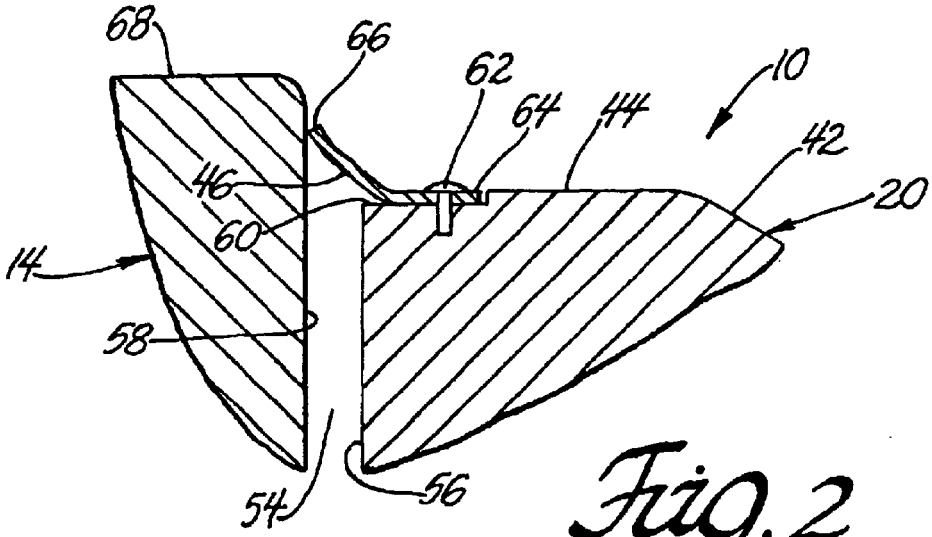
FIG. 2 illustrates a partially broken-away cross-sectional view of a portion of the flask tool assembly of FIG. 1, showing the perimeter seal bridging a gap or void between a form tool insert and a flask.

Turning now to FIGS. 2 through 5, the structure and function of the peripheral seal 46 will be discussed in more detail. FIG. 2 illustrates a cross-sectional view of part of the flask tool assembly 10 including the form tool insert 20, peripheral seal 46, and flask 14. Intentionally, a predetermined void or gap 54 is defined between a perimeter edge or exterior surface 56 of the form tool insert 20 and an interior surface 58 of the flask 14. The gap 54 is predetermined by calculating the relative manufacturing tolerances of the flask 14 and the form tool insert 20 as well as the displacement of the form tool insert 20 with respect to the flask 14 under thermal expansion due to the hot superplastic forming temperatures. A void is undesirable because the sheet metal blank would tend to be blow-formed down into the void, thereby locking the formed part between the part definition portion of the form tool insert 20 and the seal bead portion of the flask 14.

There are at least two solutions to this problem. In one solution, craftsmen can fabricate custom addendum details to fill the void. In another solution, the form die or insert 20 is custom designed and constructed to be precision fit within the surrounding tool or flask 14 so as to minimize or eliminate the void therebetween. Unfortunately, however, a precision fit necessitates precision machining and construction of the form die and surrounding tool, which is cost prohibitive, especially on a prototype or otherwise low-volume production basis. Moreover, a precision fit translates into process downtime. The form die, when heated, expands into an interference fit condition with the surrounding tool and must be permitted to cool for a significant amount of time before the die can be loosened from the surrounding tool and removed therefrom. This is of particular concern for small production runs or prototyping when several die changes may be required per week.

The peripheral seal 46 bridges and seals the gap 54 between the form tool insert 20 and the flask 14. The peripheral seal 46 is mounted flush with the addendum surface 44 of the form tool insert 20 by virtue of a recessed portion 60 of the addendum surface 44 that circumscribes the form tool insert 20. Accordingly, the peripheral seal 46 is attached to a peripheral margin of the form tool insert 20 by a plurality of button-headed fasteners 62, such as rivets, bolts, cap screws, or the like. Alternatively, however, it is contemplated that the peripheral seal 46 may be attached to the form tool insert 20 by any other heat-tolerant means including welding, interference fit, or the like. The peripheral seal 46 is thus cantilevered from a fastener end 64 that seals against the recessed portion 60 of the form tool insert 20 to a free end 66 that seals against the interior surface 58 of the flask 14. The peripheral seal 46 is sized such that an overhang from the exterior surface 56 of the form tool insert 20 to the free end 66, is greater than the width of the gap 54 at any given point around the form tool insert 20. Also, the peripheral seal 46 is preferably angled for ease of assembly, wherein the form tool insert 20 with the peripheral seal 46 attached thereto is inserted down into the interior of the flask 14.

From the above, neither the flask 14 nor the form tool insert 20 need be precision machined for fitting together and the form tool insert 20 need not be precisely centered within the flask 14, because the peripheral seal 46 absorbs or "takes up" any unbalanced dimensional slack therebetween. In other words, the gap 54 may be greater on one end or side of the form tool insert 20 than another, and the peripheral seal 46 will variably deflect in accordance with such dimensional variation to provide a uniform seal with the flask 14 around the form tool insert 20.

Figure 3:
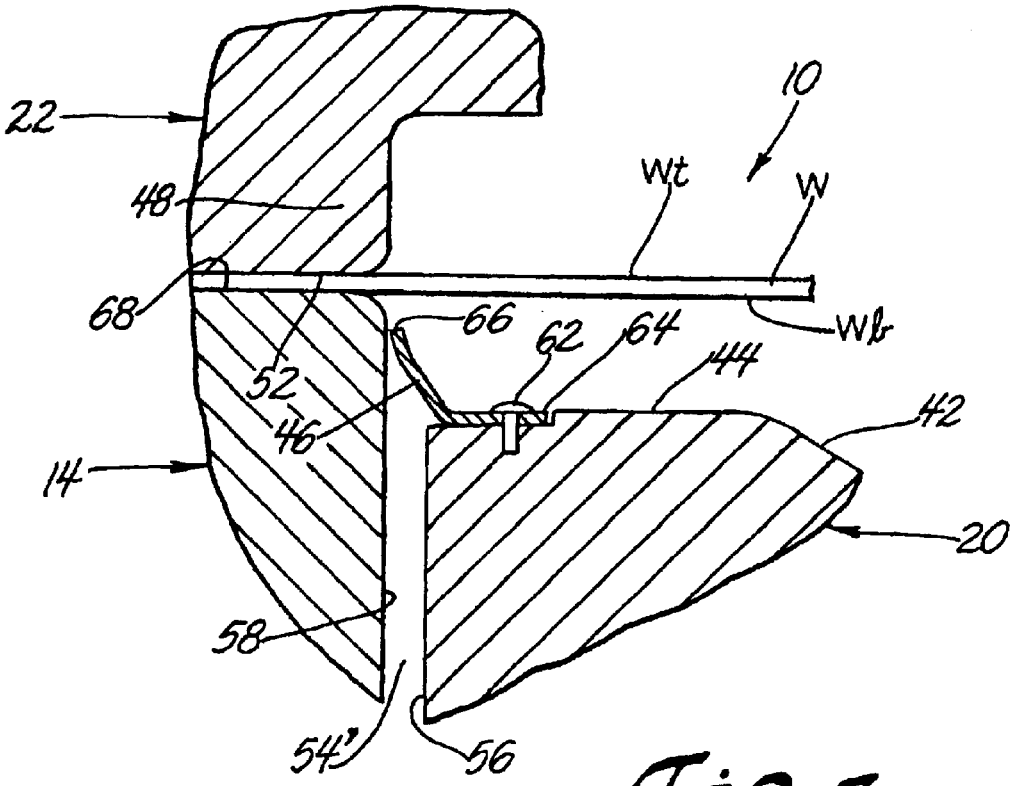
FIG. 3 illustrates a partially broken-away cross-sectional view of a portion of the flask assembly of FIG. 2, showing a sheet metal blank trapped between a cover and the flask and extended over the form tool insert and perimeter seal.

FIG. 3 depicts a particular stage in the forming process wherein a sheet metal blank W has been loaded to the flask tool assembly such that a bottom surface Wb thereof sits atop the top surface 68 of the flask 14 and above the form tool insert 20. The cover 22 has subsequently been lowered such that the machined surface 52 of the seal bead 48 engages a top surface Wt of the sheet metal blank W so as to bind the sheet metal blank W about its peripheral margin in preparation for the forming step. FIG. 3 also depicts the outward thermal expansion of the form tool insert 20 relative to the flask 14, such that the gap 54 of FIG. 2 has been reduced in width to yield a smaller gap 54' shown in FIG. 3. Accordingly, under the outward thermal displacement of the form tool insert 20, the peripheral seal 46 has deflected upwardly so as to take up the thermal expansion and keep the gap 54' sealed.

Figure 4:
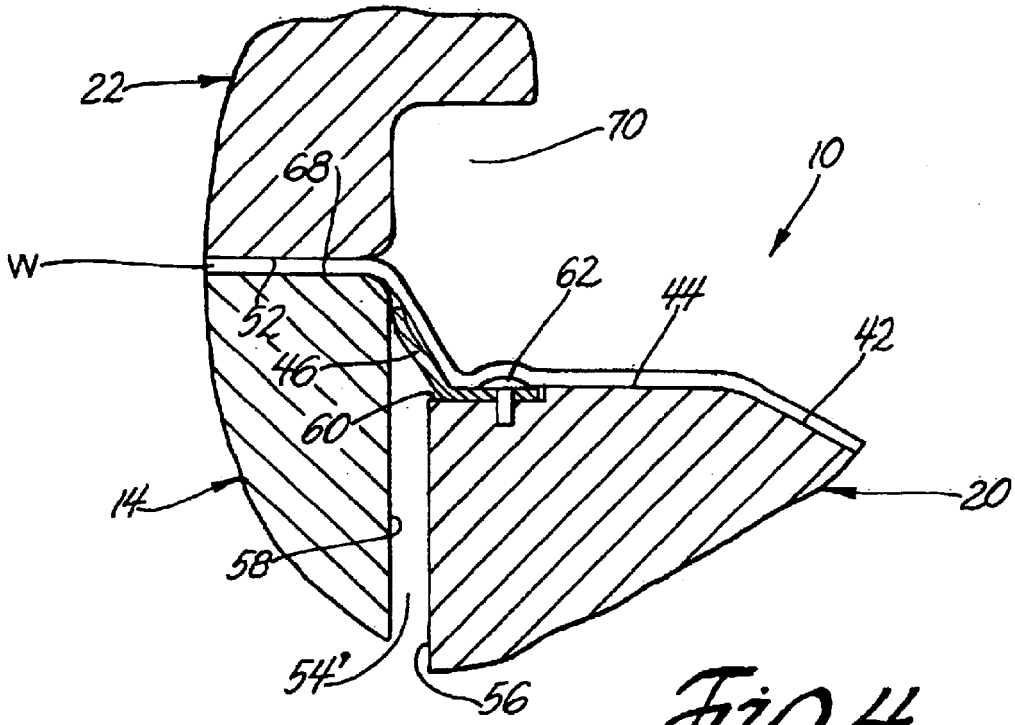
FIG. 4 illustrates a partially broken-away cross-sectional view of a portion of the flask tool assembly of FIG. 3, showing the sheet metal blank blow-formed against the form tool insert and perimeter seal.

FIG. 4 depicts the forming stage in the process wherein a pressurized gas has been introduced, preferably through the cover 22, and into a chamber 70 defined between the sheet metal blank W and the cover 22, so as to blow-form the sheet metal blank W against the form tool insert 20. Accordingly, the sheet metal blank W closely follows the contours of the forming surface 42, the addendum surface 44, the button-headed fastener 62, and the peripheral seal 46. The peripheral seal 46 thus prevents the sheet metal blank W from being blow-formed down into the gap 54' between the form tool insert 20 and the flask 14. In other words, without the peripheral seal 46 in place as shown, a marginal portion of the sheet metal blank W would be formed down into the gap 54' and would thereby pull material in a direction away from the forming surface 42 and possibly lock the finished part onto the form tool insert 20.

Figure 5:
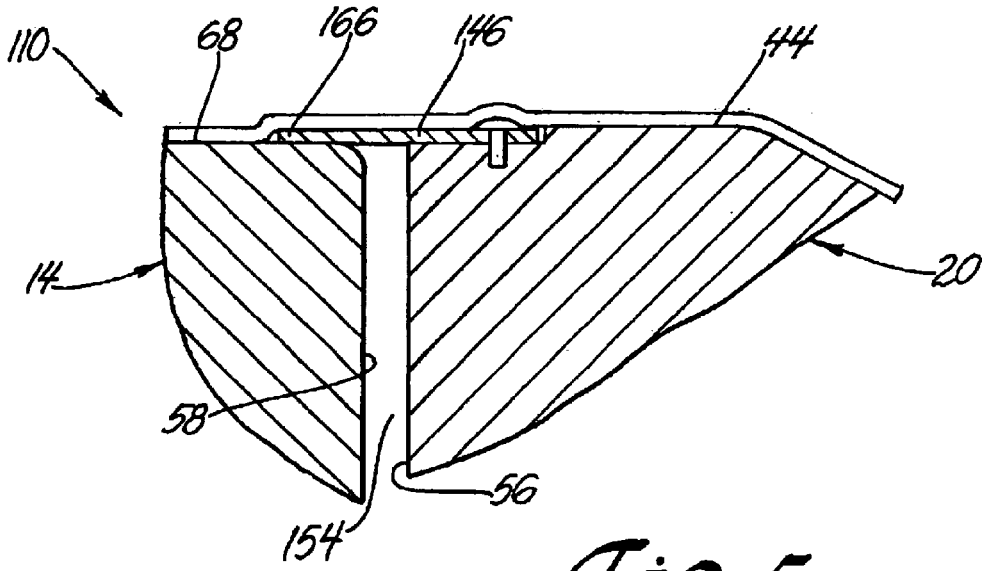
FIG. 5 illustrates a partially broken-away cross-sectional view of a portion of a flask tool assembly according to another embodiment of the present invention.

In FIGS. 2 through 4, the forming surface 42, addendum surface 44, and peripheral seal 46 are all disposed beneath a plane defined by the top surface 68 of the flask 14. In contrast, FIG. 5 illustrates a flask tool assembly 110 having the addendum surface 44 disposed slightly above a plane defined by the top surface 68 of the flask 14. This difference in height may be designed in and enabled by providing thicker spacer rails (not shown). Accordingly, a peripheral seal 146 is provided in a generally flat condition to bridge and seal the gap 154 between the form tool insert 20 and flask 14. Here, a free end 166 of the peripheral seal 146 seals against the top surface 68 of the flask 14, instead of the interior surface 58 thereof.

With all of the embodiments described above, the present invention provides a variety of advantages. First, the press, major sub-elements thereof, and the forming tooling are unheated and uninsulated. In other words, the press and tooling are not integrally heated or insulated in the sense that heating elements are not embedded therein and insulation is not attached thereto. Rather, a dedicated heater plate is integrally heated and positioned within a dedicated insulated flask. Similarly, a dedicated heated and insulated cover is provided. The combination of the heater plate, insulated flask, and heated and insulated cover enables forming cycle times that are similar to that of QPF, but avoids the costs and long lead times of providing QPF tooling. This is because such apparatus can be reused to accommodate a wide multitude of forming tools. In other words, the investment expense and lead time of providing heating elements in close proximity to the forming tool surfaces can be borne by a single, dedicated heated and insulated flask and cover. Thus, such auxiliary apparatus and expense thereof can be eliminated from each of the multitudes of forming tools that are swapped in and out of the flask.

Second, the peripheral seal prevents a sheet metal blank from being blow-formed down into a void or gap between a forming tool and a flask and enables a tooling designer to accommodate a predictable range in widths of the gap. More specifically, the peripheral seal eliminates the need to provide a precision fit between tooling components, thereby enabling use of looser dimensional tolerances in the manufacture of the components. Looser tolerances yield reduced machining operations and time, which leads to reduced manufacturing costs. Moreover, the peripheral seal enables use of a gap between the tooling, and thereby facilitates "hot" tooling to be swapped out for "cold" tooling without having to wait for the hot die to cool and contract away from the hot flask. This yields reduced time required for tool changes, which leads to reduced manufacturing cost. Similarly, the peripheral seal enables use of tooling materials having different coefficients of thermal expansion, thereby providing more tooling options for a tooling designer, which thereby leads to increased part quality and reduced part cost. Thus, the present invention provides parts of uncompromised quality at a reduced manufacturing cost, while providing the flexibility to rapidly change tooling on a low volume production basis.

It should be understood that the invention is not limited to the embodiments that have been illustrated and described herein, but that various changes may be made without departing from the spirit and scope of the invention. For example, the materials, dimensions, and the like disclosed herein are for exemplary purposes only. Accordingly, it is intended that the invention not be limited to the disclosed embodiments, but that it have the full scope permitted by the language of the following claims.

What is claimed is:

1. An apparatus for hot gas blow-forming a sheet metal blank into a finished component, said apparatus comprising:

a flask having an exterior periphery and an interior periphery, said flask being sized and adapted to receive different dies of various size and shape for hot gas blow-forming, said flask further having sides with top surfaces for supporting said sheet metal blank thereon;

a heater plate positioned within said flask and adapted to contact one of said different dies for separately heating said one of said different dies;

said one of said different dies having a forming surface for forming said sheet metal blank into said finished component, said one of said different dies further having an exterior periphery and being mounted within said flask against said heater plate; and a cover positioned opposite said flask and having portions adapted to engage said sheet metal blank against said top surfaces of said sides of said flask, said cover thereby at least partially defining a pressure chamber between said sheet metal blank and said cover.

2. An apparatus as claimed in claim 1, wherein a peripheral gap is established between said exterior periphery of said one of said different dies and said interior periphery of said flask, said apparatus further comprising a seal mounted to at least one of said flask and said one of said different dies so as to bridge said peripheral gap.

3. An apparatus as claimed in claim 2, wherein said seal has one end sealingly attached to said one of said different dies and an opposite end in sealing contact with said flask.

4. An apparatus as claimed in claim 3, wherein said one of said different dies includes an addendum surface thereon and said seal is angled in a direction generally away from said addendum surface.

5. An apparatus as claimed in claim 3, wherein said seal is substantially flat from said one end to said opposite end.

6. An apparatus as claimed in claim 1, further comprising an insulation enclosure at least partially surrounding said exterior periphery of said flask.

7. An apparatus for hot-gas blow-forming a sheet metal blank into a finished component, said apparatus comprising:

a flask having sides with top surfaces for supporting said sheet metal blank thereon, said flask further having internal side surfaces that define an interior of said flask, said flask being sized and adapted to receive different dies of various size and shape for hot gas blow-forming;

an insulation enclosure at least partially externally surrounding said sides of said flask;

one of said different dies having a forming surface thereon for forming said sheet metal blank into said finished component and an addendum surface circumscribing said forming surface, said one of said different dies further having external side surfaces therearound, said one of said different dies being positioned within said interior of said flask such that a peripheral gap is defined between said external side surfaces and said internal side surfaces of said flask;

a heater plate positioned within said flask and adapted to contact said one of said different dies for individually heating said one of said different dies; and a cover positioned opposite said flask, said cover having a bead for binding said sheet metal blank between said top surfaces of said flask and said bead, said cover thereby defining a pressure chamber between said sheet metal blank and said cover.

8. An apparatus as claimed in claim 7, further comprising a peripheral seal mounted to said addendum surface of said one of said different dies so as to bridge said peripheral gap between said flask and said one of said different dies.

9. An apparatus as claimed in claim 8, wherein said peripheral seal has one end sealingly attached to said addendum surface of said one of said different dies and an opposite end in sealing contact with said flask.

10. An apparatus as claimed in claim 9, wherein said peripheral seal is angled in a direction generally away from said addendum surface of said one of said different dies and terminates in said opposite end in contact with said internal side surfaces of said flask.

11. An apparatus as claimed in claim 9, wherein said peripheral seal is substantially flat from said one end to said opposite end, said opposite end being in contact with said top surfaces of said flask.

12. An apparatus for hot-gas blow-forming a substantially two-dimensional sheet metal blank into a substantially three-dimensional finished component, said apparatus comprising:

a substantially rectangular flask having four sides with top surfaces for supporting said sheet metal blank and having internal side surfaces that define an interior, said flask being sized and adapted to receive different dies of various size and shape for hot gas blow-forming;

one of said different dies being of substantially rectangular shape and having a forming surface thereon for forming said sheet metal blank into said finished component and an addendum surface circumscribing said forming surface, said one of said different dies further having four external side surfaces therearound, said one of said different dies being positioned within said interior of said flask such that a peripheral gap is defined between said external side surfaces and said internal side surfaces of said flask;

a heater plate having electrical resistance heating elements provided therein, said heater plate being positioned within said flask and adapted to contact said one of said different dies for heating said one of said different dies; and a substantially rectangular cover positioned opposite said flask, said cover having a bead for binding said sheet metal blank between said top surfaces of said flask and said bead, said cover thereby defining a pressure chamber between said sheet metal blank and said cover.

13. An apparatus as claimed in claim 12, further comprising a substantially rectangular peripheral seal mounted to said addendum surface of said one of said different dies so as to bridge said peripheral gap between said flask and said one of said different dies.

14. An apparatus as claimed in claim 13, wherein said peripheral seal has one end sealingly attached to said addendum surface of said one of said different dies and an opposite end in sealing contact with said flask.

15. An apparatus as claimed in claim 14, wherein said peripheral seal is angled in a direction generally away from said addendum surface of said one of said different dies and terminates in said opposite in contact with said internal side surfaces of said flask.

16. An apparatus as claimed in claim 14, wherein said peripheral seal is substantially flat from said one end to said opposite end, said opposite end being in contact with said top surfaces of said flask.

* * * * *